US005418590A

United States Patent [19]

Earle et al.

[11] Patent Number: 5,418,590

[45] Date of Patent: May 23, 1995

[54] PHOTOGRAPHIC PROCESSING APPARATUS

[75] Inventors: Anthony Earle, Middlesex; John R. Fyson, London; Paul C. Ward, Herts, all of United Kingdom

[73] Assignee: Eastman Kodak Company, Rochester, N.Y.

[21] Appl. No.: 119,239

[22] PCT Filed: Mar. 23, 1992

[86] PCT No.: PCT/EP92/00632

§ 371 Date: Sep. 24, 1994

§ 102(e) Date: Sep. 24, 1994

[87] PCT Pub. No.: WO92/17819

PCT Pub. Date: Oct. 15, 1992

[30] Foreign Application Priority Data

Mar. 26, 1991 [GB] United Kingdom ..... 9106369

[51] Int. Cl.[6] ..... G03D 5/00

[52] U.S. Cl. ..... 354/318

[58] Field of Search ..... 354/317–324, 354/325; 118/650, 651, 661, 662; 134/64 P, 64 R, 122 P, 122 R; 430/398–400, 404

[56] References Cited

U.S. PATENT DOCUMENTS

| | | | |
|---|---|---|---|
| 3,308,737 | 3/1967 | Fukuda | 354/31 |
| 3,418,912 | 12/1968 | Land et al. | 354/318 |
| 4,310,620 | 1/1992 | Meyer | 430/404 |

FOREIGN PATENT DOCUMENTS

| | | |
|---|---|---|
| 410790A2 | 1/1991 | European Pat. Off. . |
| WO83/03146 | 9/1983 | WIPO . |
| WO89/03728 | 5/1989 | WIPO . |
| WO91/03767 | 3/1991 | WIPO . |

*Primary Examiner*—D. Rutledge

*Attorney, Agent, or Firm*—Nixon, Hargrave, Devans & Doyle

[57] ABSTRACT

It is well known to use a transport belt to transport material being processed through photographic processing apparatus. In some arrangements, water is used to hold photographic material against the belt using surface tension. However, other means are needed to apply processing solution to the sensitized surface of the material being processed. Described herein is an arrangement in which the transport belt (10) is used to both transport the material (32,34) through the apparatus and to apply processing solution (18) to the sensitized surface.

5 Claims, 3 Drawing Sheets

PHOTOGRAPHIC PROCESSING APPARATUS

BACKGROUND OF THE INVENTION

1. Field of the Invention

This invention relates to photographic processing apparatus and is more particularly concerned with apparatus in which the photographic material being processed is held in place during the transport cycle by active processing chemicals.

2. Description of the Related Art

International patent application PCT/US90/04918 discloses a transport system in which the back or unsensitized surface of photographic material is held by capillary action against a surface of a transport belt. The belt surface is wetted with water and the material to be processed is placed on to the belt with its sensitized surface facing upwards. Active processing chemicals are then applied to the sensitized surface of the material as it is advanced through the processing apparatus by the belt.

Photographic processes are also known where a chemical package is held against the sensitized surface to affect treatment. Two examples of this type of treatment are in the field of instant photography and a presoaked bi-mat belt.

WO89/03728 discloses an arrangement in which processing solutions are supplied to a porous material against which sheet material is transported during processing. The sheet material is transported by means of a belt which acts in conjunction with the porous material to apply the solutions to the material being processed.

U.S. Pat. No. 4,310,620 discloses an arrangement in which a porous spreading element in the form of an endless flexible web moves over a system of deflecting rollers to apply processing solutions to the sensitized surface of the photographic material. At least one of the deflecting rollers is mounted within a processing tank and impregnates the flexible web with processing solution, the material to be processed being introduced between the deflecting roller and the moving web with its sensitized surface being held against the web.

This arrangement has the disadvantage of requiring large volumes of processing solution for application to the moving web and cannot be used with inherently unstable processing solutions.

SUMMARY OF THE INVENTION

According to one aspect of the present invention, there is provided photographic processing apparatus for processing photographic material comprising:

a reservoir containing photographic processing solution; and a transport belt carried by a plurality of rollers and arranged to pass through the reservoir to pick up processing solution;

characterized in that photographic material to be processed is retained on the transport belt by surface tension of the processing solution carried thereon.

Advantageously, processing solution application means are provided for applying further processing solution on to the transport belt. In one embodiment, the solution is applied to the transport belt, and in another embodiment, directly to the material to be processed as it enters the apparatus.

By this arrangement, active photographic chemicals can be applied to a moving belt on to which photographic materials are laid with their sensitized surfaces against the belt for both for treatment and transport through processing apparatus.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
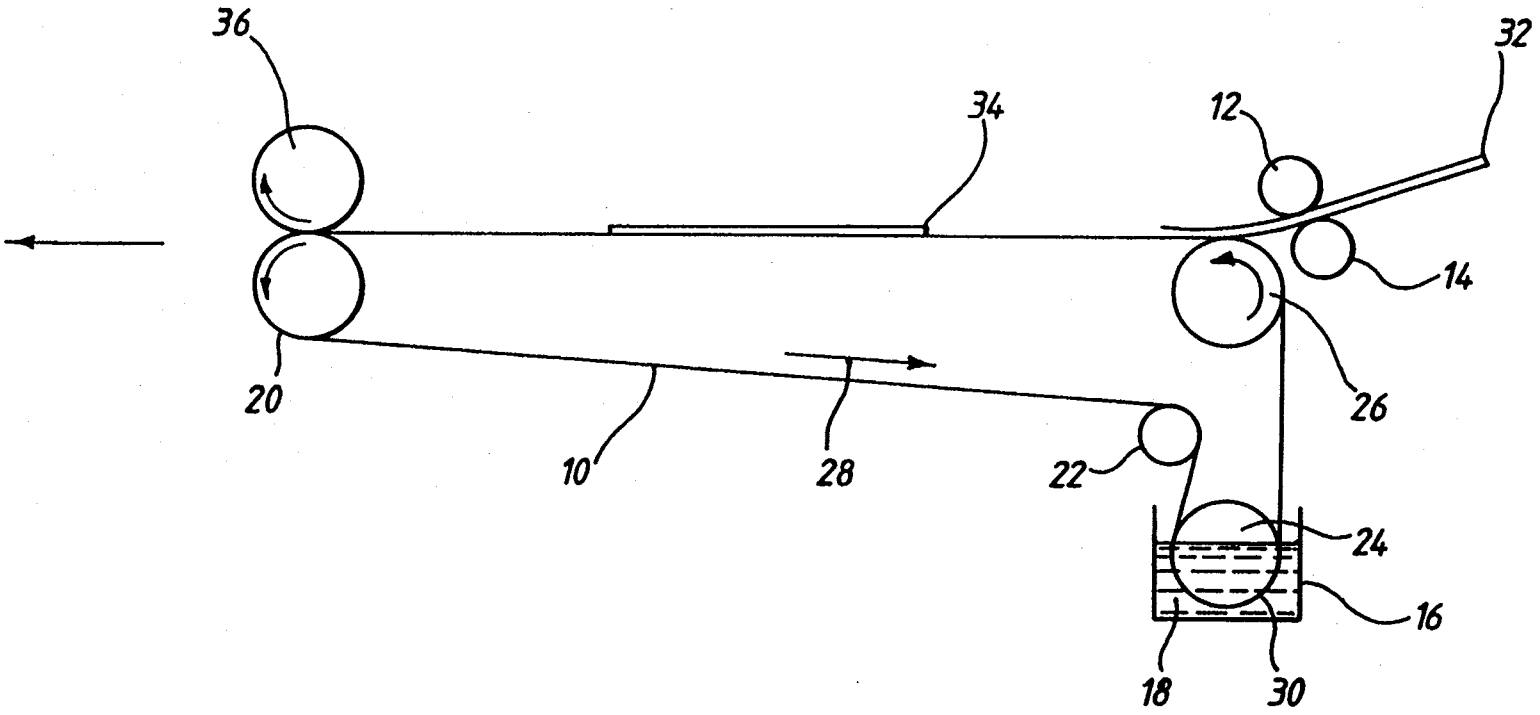
FIG. 1 illustrates one embodiment of apparatus constructed in accordance with the present invention.

In FIG. 1, a single stage embodiment of apparatus according to the present invention is shown. The apparatus comprises a transport belt 10, inlet feed rollers 12, 14 and a reservoir 16 containing processing solution 18. The transport belt 10 is carried by rollers 20, 22, 24, 26, and driven in the direction of arrow 28 by a conventional motor (not shown).

As the belt 10 passes around roller 24, it picks up a thin layer 30 of processing solution 18 from reservoir 16. This layer 30 is carried by the belt 10 upwards and over roller 26. At this point, a sheet 32 of photographic material to be processed is introduced on to the surface of the belt 10 through inlet rollers 12, 14. The sensitized surface of the sheet 32 is brought into contact with the layer 30 of processing solution 18 carried by the belt 10 and is firmly held there by capillary action. The sheet 32 and belt 10 then move along together. A previously introduced sheet of material is indicated by 34.

The speed of the belt 10 is set so that when the sheet 32 emerges from between rollers 20, 36, processing of the sheet 32 is complete.

Figure 2:
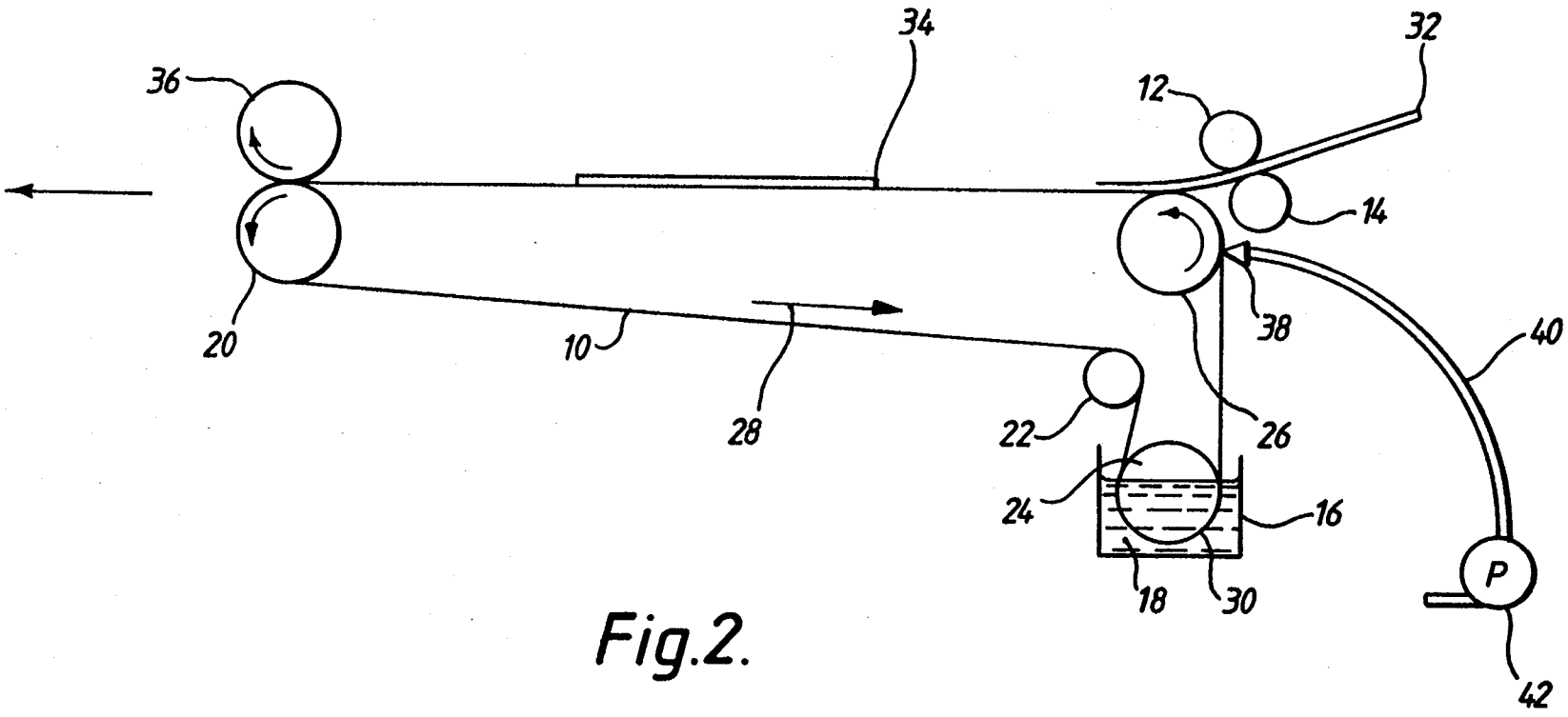
FIG. 2 is similar to FIG. 1 but illustrating the use of a separate processing chemical delivery point.

FIG. 2 is similar to FIG. 1 and like components are identically referenced. In the embodiment of the present invention shown in FIG. 2, processing solution is delivered to the belt 10 close to where the sheet 32 is introduced. A small dispensing hopper 38 supplies processing solution directly on to the surface of the belt 10 as shown. The hopper 38 is supplied by a pipe 40 which is connected to a pump 42. In this embodiment, processing solution is only delivered to the belt 10 when a sheet of material to be treated is sensed.

Figure 3:
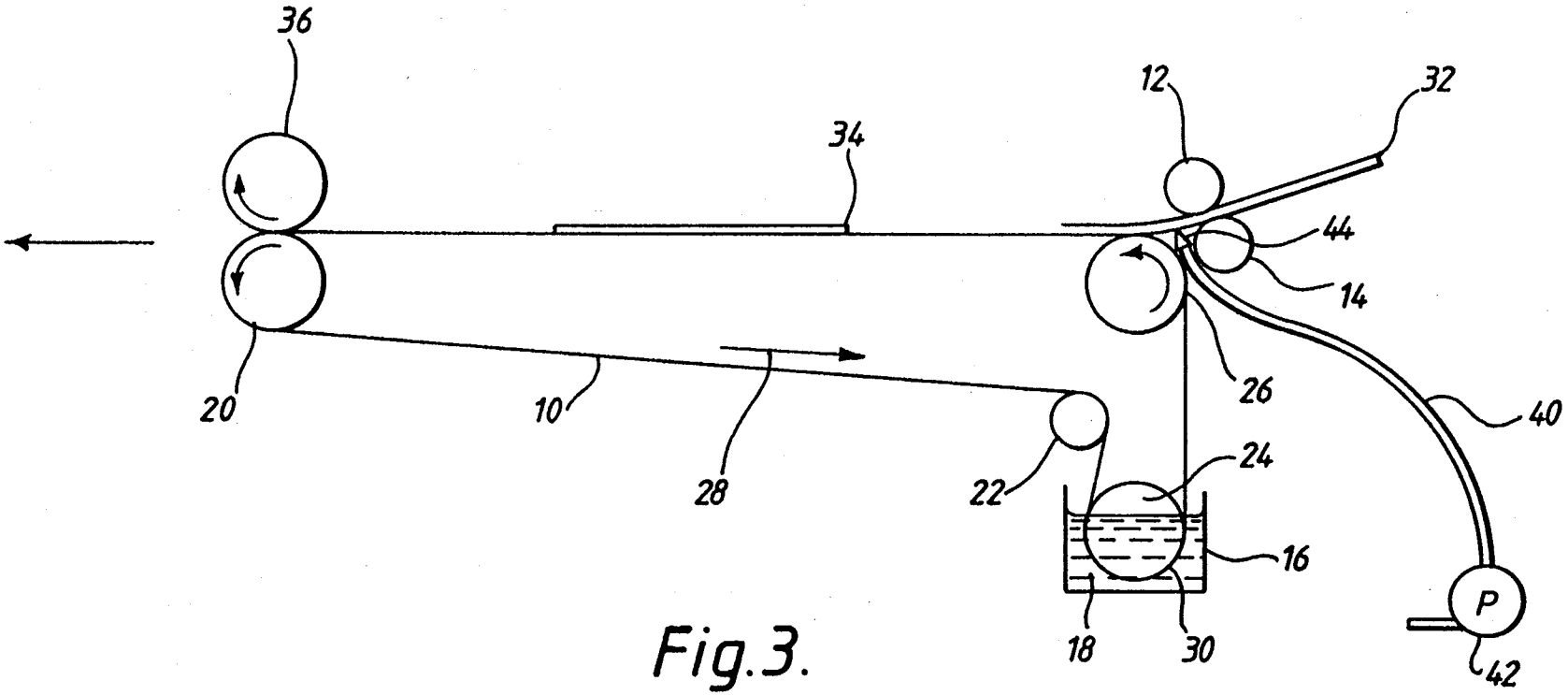
FIG. 3 is similar to FIG. 2 but illustrating direct application of processing chemical to the material being processed.

In FIG. 3, a dispensing hopper 44 similar to that shown in FIG. 2 is used to apply processing solution directly on to the sensitized surface of the sheet of material 32 as it emerges from the inlet feed rollers 12, 14. Again, like items are identically referenced.

The delivery of processing solution to the hopper 44 is activated by a sensor (not shown) which detects the presence of a sheet 32 and starts pump 42 to supply solution through pipe 40.

In order to keep the transport belt 10 short, it can be stopped for the correct processing time with sheets 32, 34 held on it. This has the added advantage of reducing access time, as the sheets are moved on to the belt quickly slowed or stopped then moved off quickly.

Apparatus according to the present invention has the following advantages:

1) Delivery of small volumes of processing solution are simplified.

2) The need for a separate arrangement for holding the material being processed in place is eliminated.

3) There is less effluent produced.

4) Even wetting is ensured.

5) Less chemicals are required for processing and they can be mixed just before they are required.

6) Drying from the material surface is eliminated.

Apparatus described above can be used for processing all types of conventional and 'RX' black and white and colour papers and films.

This invention could also be used to process paper in which the developing agent was incorporated into the photographic material and an activator solution was applied to the belt. This activator may or may not contain base or peroxide solutions.

Three experiments were carried out using the apparatus described above. The experiments were carried out in safelight for black and white prints and total darkness for those in colour.

Experiment 1

The apparatus as shown in FIG. 1 was used with a viscous processing solution in the reservoir 16. The processing solution used was KODAK DEKTOL developer liquid which had been diluted and thickened by the addition of 250 ml glycerol to 11 of DEKTOL. A piece of KODABROME Grade 3, black and white photographic paper was exposed to an image from a black and white negative enlarger in the usual manner.

The transport belt 10 was started at a speed of about 5 $cms^{-1}$, and a short time was allowed to elapse to allow the solution to coat the belt. The exposed paper was then slid on to the belt 10 and released with the emulsion surface towards the belt 10. The paper was pulled on to the belt 10 by the surface tension forces existing between the liquid on the belt and the paper. The paper travelled along with the belt and was released from the belt when it passed through rollers 12, 36.

The paper was then caught and held in the air for 30 s. The print was then immersed in a bath of diluted RAPID-FIXER. The print was washed and dried in the usual manner. The image on the paper was comparable to one processed in the usual manner using open dishes.

Experiment 2

An thickened 'RX' developer was made using the following formula:

| | |
|---|---|
| diethylene glycol | 200 ml |
| glycerol | 300 ml |
| diethylhydroxyamine | 5 ml |
| CD3 | 20 g |
| potassium carbonate | 20 g |
| water to | 1 l |
| pH adjusted to 10.7 with potassium hydroxide | |

Just before use, 20 ml/liter of 30% hydrogen peroxide was added to the mixture.

This developer was poured into the reservoir 16 as shown in FIG. 1. A fish tank heater was placed in the developer and the solution temperature was raised to 40° C. The belt was started and the speed adjusted to about 5 $cms^{-1}$. It was allowed to run to warm the belt and cover it evenly with developer.

A piece of colour paper suitable for 'RX' processing (3 $mgft^{-2}$ silver in cyan layer, 4 $mgft^{-2}$ silver in magenta layer and 6.5 $mgft^{-2}$ silver in yellow layer) was exposed to a colour negative of an average outdoor scene, in the usual way using an enlarger. The paper was then put on to the belt 10, emulsion face towards the belt. The paper was then allowed to travel on to the belt, but once there was manually held stationary for 1 min so that the belt carried developer solution over the print.

The paper was then released and allowed to travel to the end of the belt where it came off. It was caught and placed in some diluted RAPID-FIXER for 1 min. The print was washed and dried in the usual manner the print obtained was a reasonable print showing good maximum density and tone scale.

Experiment 3

Experiment 2 was repeated using the same conditions except that 2 $gl^{-1}$ hydroxymethyl cellulose was added to the developer. The remainder of the experiment was the same, except that the paper was released when it went on to the belt and the belt was stopped for one minute once all the paper was on it.

After 1 min had elapsed the belt was started again. The print came off after passing rollers 12, 36. The paper was then fixed, washed and dried as described above. The print obtained had good maximum density and tone scale.

We claim:

1. Photographic processing apparatus for processing photographic material comprising:

a reservoir containing photographic processing solution; and a transport belt carried by a plurality of rollers and arranged to pass through the reservoir to pick up processing solution;

characterized in that photographic material to be processed is retained on the transport belt by surface tension of the processing solution carried thereon.

2. Apparatus according to claim 1, further including processing solution application means for applying further processing solution on to the transport belt.

3. Apparatus according to claim 1, further including processing solution application means for applying further processing solution directly on to the photographic material.

4. Apparatus according to claim 3, wherein the further processing solution application means is activated by a sensor which senses the presence of photographic material to be processed.

5. Apparatus according to claim 2, the further processing solution application means comprises a dispensing hopper which is connected to a pump by conduit means, the pump supplying further processing solution to the hopper when operative.

* * * * *